US007066567B2

(12) United States Patent
Nishino

(10) Patent No.: US 7,066,567 B2
(45) Date of Patent: Jun. 27, 2006

(54) INKJET PRINTER

(75) Inventor: Satoshi Nishino, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 213 days.

(21) Appl. No.: 10/756,704

(22) Filed: Jan. 12, 2004

(65) Prior Publication Data

US 2004/0145619 A1 Jul. 29, 2004

(30) Foreign Application Priority Data

Jan. 28, 2003 (JP) ..... 2003-018604

(51) Int. Cl.
*B41J 29/38* (2006.01)

(52) U.S. Cl. ..... 347/17; 347/19; 347/60

(58) Field of Classification Search ..... None
See application file for complete search history.

(56) References Cited

U.S. PATENT DOCUMENTS 5,975,669 A * 11/1999 Ohshima ..... 347/14
5,988,784 A * 11/1999 Takemura et al. ..... 347/8
6,102,514 A * 8/2000 Otsuka et al. ..... 347/17
6,196,672 B1 * 3/2001 Ito et al. ..... 347/88
6,390,617 B1 * 5/2002 Iwao ..... 347/102
6,457,797 B1 * 10/2002 Van Der Meijs et al. ..... 347/14
2001/0028375 A1 * 10/2001 Ohtani et al. ..... 347/37

FOREIGN PATENT DOCUMENTS

JP 62-039261 A 2/1987

* cited by examiner

*Primary Examiner*—Thinh Nguyen
*Assistant Examiner*—Brian J. Goldberg
(74) *Attorney, Agent, or Firm*—Frishauf, Holtz, Goodman & Chick, P.C.

(57) ABSTRACT

An inkjet printer for jetting ink of the optimal viscosity for image-recording during recording operation. The inkjet printer includes: a temperature sensor for detecting a temperature of the ink in a recording head; a heater for heating the ink in the recording head by generating heat; and a control unit for controlling the heater based on a result detected by the temperature sensor. In the control unit, a set value for defining a heating temperature of the heater is stored, and first factors including movement speed of a carriage and the number of times of movement of a carriage, and a first correction value corresponding to the first factors are stored as a first data table. The control unit specifies the first correction value from image information, corrects the set value based on the first correction value, and controls the heater for generating heat according to the corrected set value.

4 Claims, 8 Drawing Sheets

| RESOLUTION (dpi) | MOVEMENT SPEED OF CARRIAGE (m/s) | THE NUMBER OF TIMES OF MOVEMENT OF CARRIAGE | RECORDING AREA (PIXEL ELEMENTS NUMBER) | RECORDING MEDIUM WIDTH (mm) | FIRST CORRECTION VALUE (℃) |
|---|---|---|---|---|---|
| 720 | 0.5 | 20 | 50000~100000 | 200 | +2.5 |
| 720 | 0.5 | 20 | 50000~100000 | 300 | +2 |
| 720 | 0.5 | 20 | 50000~100000 | 400 | +1.5 |
| 720 | 0.5 | 20 | 50000~100000 | 500 | +1 |

| FIRST CORRECTION VALUE (℃) | DETECTED TEMPERATURE IN NEIGHBORHOOD OF NOZZLES OF EACH RECORDING HEAD (℃) | SECOND CORRECTION VALUE (℃) |
|---|---|---|
| +2 | 26 | +4 |
| +2 | 26.5 | +3.5 |
| +2 | 27 | +3 |
| +2 | 27.5 | +2.5 |

| FIRST CORRECTION VALUE (℃) | DETECTED TEMPERATURE OF RECORDING MEDIUM (℃) | THIRD CORRECTION VALUE (℃) |
|---|---|---|
| | | |
| +2 | 54 | -2 |
| +2 | 52 | 0 |
| +2 | 50 | +2 |
| +2 | 48 | +4 |
| | | |

| FIRST CORRECTION VALUE (℃) | DETECTED TEMPERATURE OF PLATEN (℃) | FOURTH CORRECTION VALUE (℃) |
|---|---|---|
| +2 | 54 | -2 |
| +2 | 52 | 0 |
| +2 | 50 | +2 |
| +2 | 48 | +4 |

INKJET PRINTER

BACKGROUND OF THE INVENTION

1. Field of the Invention

The present invention relates to an inkjet printer. In particular, the invention relates to temperature control of ink in a recording head.

2. Description of Related Art

As a recording terminal connected to a word processor, a personal computer or the like, various kinds of printers such as a dot impact printer, an inkjet printer, a laser printer, a thermal transfer printer, a dye sublimation printer or the like have been developed. Among all, compared with the printers of other systems, the inkjet printer has advantages that it is more noiseless during the recording and can record colorful images easier and more inexpensively. Therefore, the inkjet printer has been the mainstream of the printers.

In the inkjet printer, a recording head comprising many orifices (nozzles) is mounted in a carriage movable in the back-and-forth direction. The inkjet printer moves the carriage in the back-and-forth direction perpendicular to the conveyance direction of the recording medium. During the back-and-forth movement, the inkjet printer records an image by jetting the ink from each nozzle of the recording head onto the recording medium in accordance with image information. Here, viscosity of the ink jetted from each nozzle is changed according to the changes in temperature (viscosity increases according to decrease in temperature). For this reason, during the image-recording, the recording head is heated and controlled by a heater, and then the ink is jetted from each nozzle at a predefined temperature (a set value) set beforehand (for example, refer to Published Unexamined Japanese Patent Application No. S62-39261).

However, as for related inkjet printers, during the movement of the carriage, air flow occurs in the neighborhood of the nozzles of the recording head, and a temperature in the neighborhood of the nozzles becomes lower than that of outside air. For this reason, in practice, the ink jetted from each nozzle of the recording heads is jetted at lower temperature than the set value. Therefore, even if the optimal set value for the image-recording has been set, the viscosity of the ink increases according to decrease of its temperature. As a result, the ink having an optimal viscosity for the image-recording is not always jetted from each nozzle during the image-recording.

SUMMARY OF THE INVENTION

An object of the present invention is to provide an inkjet printer capable of jetting ink of the optimal viscosity for image-recording during image-recording operation.

In accordance with a first aspect of the present invention, an inkjet printer comprises:

a recording head having a plurality of nozzles for jetting ink;

a movable carriage for mounting the recording head, the inkjet printer recording an image on a recording medium by jetting the ink from each nozzle of the recording head while the carriage is moved based on image information;

a first temperature sensor for detecting a temperature of the ink in the recording head;

a heater for heating the ink in the recording head by generating heat; and a control unit for controlling the heater based on a result detected by the first temperature sensor, wherein in the control unit, a set value for defining a heating temperature of the heater is stored, and first factors including movement speed of the carriage and the number of times of movement of the carriage, which are determined based on the image information, and a first correction value corresponding to the first factors are stored as a first data table; and wherein the control unit determines the first factors including the movement speed of the carriage and the number of times of movement of the carriage from the image information, specifies the first correction value corresponding to the determined first factors from the first data table, corrects the set value based on the specified first correction value, and controls the heater for generating heat in accordance with the corrected set value.

According to the printer of the first aspect of the present invention, the control unit specifies the first correction value from the image information and corrects the set value based on the first correction value. Therefore, during the image-recording operation, even if the temperature in the neighborhood of the nozzles of the recording head becomes lower than that of outside air in accordance with the movement of the carriage, the ink can be jetted from each nozzle of the recording head at the temperature close to the set value. For this reason, during the image-recording operation, the ink of the optimal viscosity for the image-recording can be jetted. Consequently, the quality of the image can be improved.

It is preferred that the printer according to the first aspect of the present invention comprises:

a second temperature sensor for detecting a temperature in the neighborhood of the nozzles of the recording head, wherein in the control unit, second factors including the first correction value and a result detected by the second temperature sensor, and a second correction value corresponding to the second factors are stored as a second data table; and wherein the control unit specifies the second correction value corresponding to the first correction value specified from the first data table and the result detected by the second temperature sensor from the second data table, corrects the set value based on the specified second correction value, and controls the heater for generating heat in accordance with the corrected set value.

In the present printer, in addition to the correction of the set value based on the first correction value as mentioned above, moreover, the temperature in the neighborhood of the nozzles of the recording head is detected by the second temperature sensor. And then, the set value is corrected based on the second correction value. Therefore, the ink can be jetted from each nozzle of the recording head at the temperature extremely close to the set value. Moreover, during the image-recording operation, ink of the optimal viscosity for the image-recording can be jetted certainly.

It is preferred that the printer of the first aspect of the present invention comprises:

a third temperature sensor for detecting a temperature of the recording medium, wherein in the control unit, third factors including the first correction value and a result detected by the third temperature sensor, and a third correction value corresponding to the third factors are stored as a third data table; and wherein the control unit specifies the third correction value corresponding to the first correction value specified from the first data table and the result detected by the third temperature sensor from the third data table, corrects the set value based on the specified third correction value, and controls the heater for generating heat in accordance with the corrected set value.

In the present printer, in addition to the correction of the set value based on the first correction value as mentioned above, moreover, the temperature of the recording medium is detected by the third temperature sensor. And then, the set value is corrected based on the third correction value. Therefore, the ink corresponding to the temperature of the recording medium can be jetted from each nozzle of the recording head. Consequently, the quality of the image recorded on the recording medium can be improved.

It is preferred that the printer according to the first aspect of the present invention comprises:

a platen for supporting the recording medium; and a fourth temperature sensor for detecting a temperature of the platen, wherein in the control unit, fourth factors including the first correction value and a result detected by the fourth temperature sensor, and a fourth correction value corresponding to the fourth factors are stored as a fourth data table; and wherein the control unit specifies the fourth correction value corresponding to the first correction value specified from the first data table and the result detected by the fourth temperature sensor from the fourth data table, corrects the set value based on the specified fourth correction value, and controls the heater for generating heat in accordance with the corrected set value.

In the present printer, in addition to the correction of the set value based on the first correction value as mentioned above, moreover, the temperature of the platen is detected by the fourth temperature sensor. And then, the set value is corrected based on the fourth correction value. Therefore, the ink corresponding to the temperature of the platen (in other words, the temperature of the recording medium, to which the heat of the platen is conducted) can be jetted from each nozzle of the recording head. Consequently, the quality of the image recorded on the recording medium can be improved.

Preferably, in the printer according to the first aspect of the present invention, the ink has the viscosity of 10 to 500 mPas at 30° C. and is cationic polymerization system photocurable ink including cationic polymerizable chemical compound.

In the present printer, since the ink is cationic polymerization system photocurable ink, it can be cured with low illumination light.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, an inkjet printer according to the present invention will be explained with reference to the drawings. However, the scope of the invention is not limited to the illustrated figures.

First Embodiment

First, the first embodiment will be explained. With reference to FIG. 1 and FIG. 2, a structure of the inkjet printer will be explained.

Figure 1A:
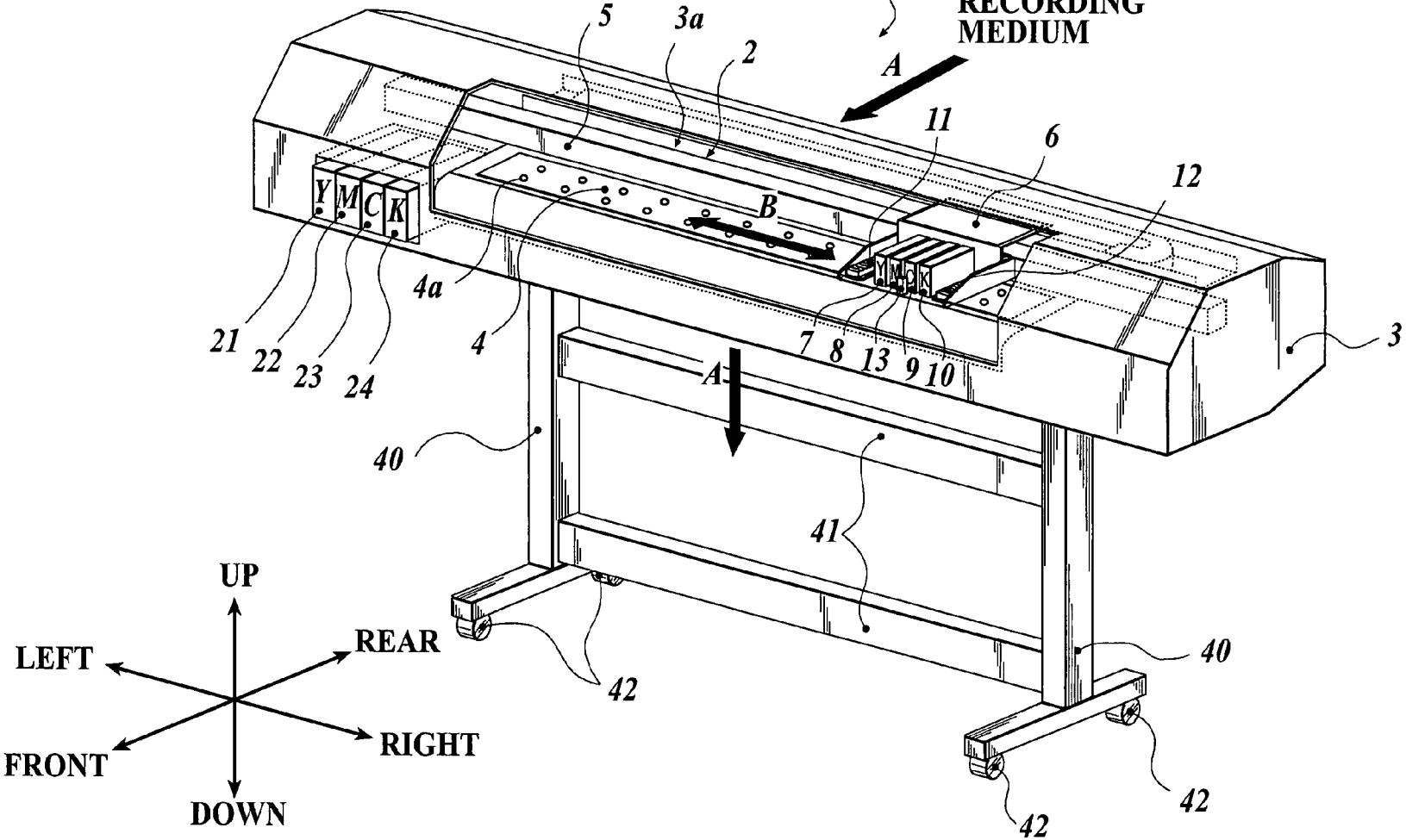
FIG. 1A is a perspective view showing a whole structure of the inkjet printer in the first embodiment.
Figure 1B:
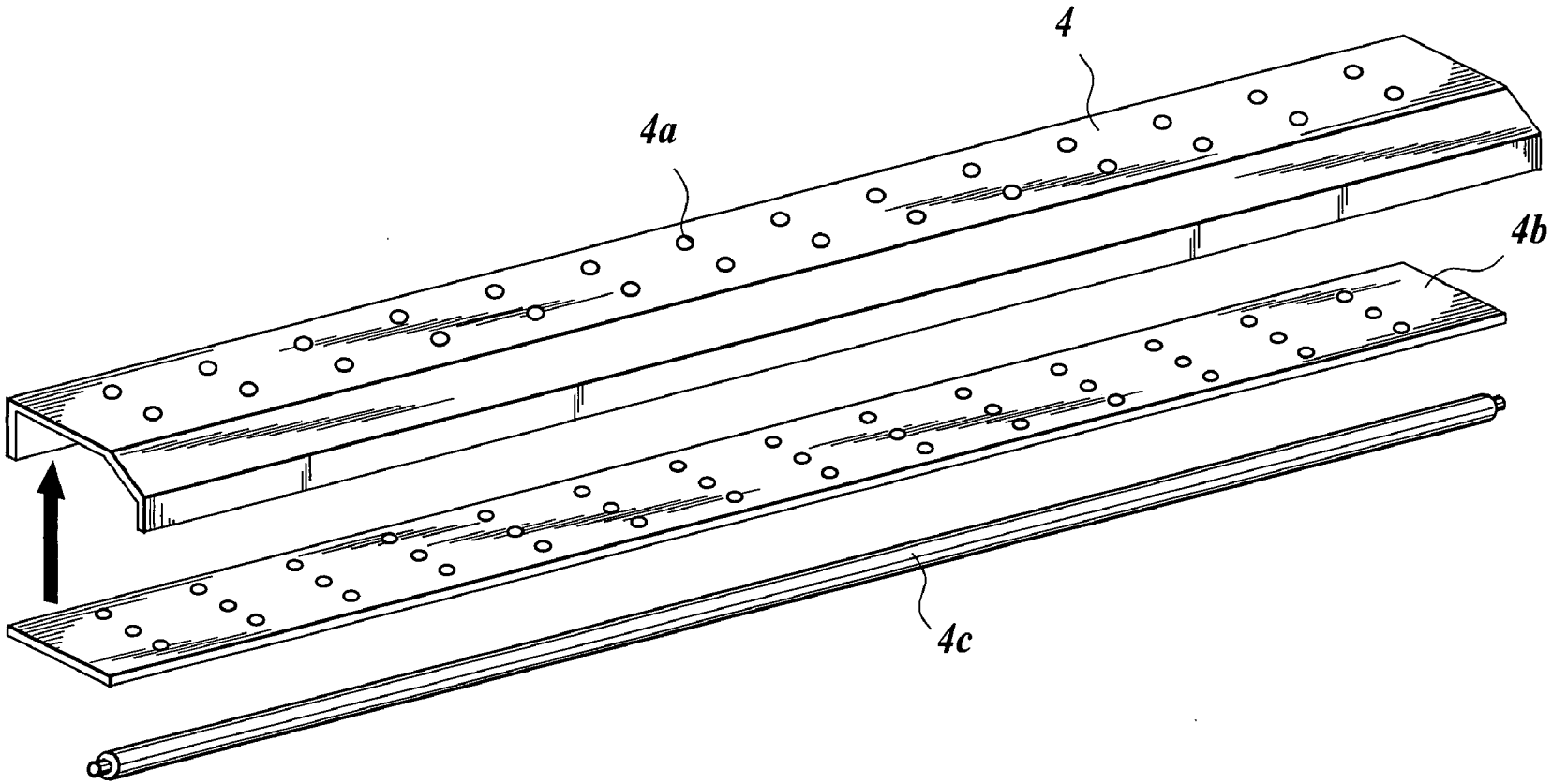
FIG. 1B is a perspective view showing part of structure of the inkjet printer in the first embodiment.

FIG. 1A is a perspective view showing a whole structure of the inkjet printer 1. FIG. 1B is a perspective view showing part of structure of the inkjet printer 1.

As shown in FIG. 1A, the inkjet printer 1 comprises an image-recording unit 2 as a unit for image-recording operation on a recording medium. In the image-recording unit 2, a plurality of various recording system members for recording an image on the recording medium are placed. The image-recording unit 2 is partly covered with an elongated housing 3 whose right-and-left side faces are polygonal and which extends in the right-and-left direction. In the front of the housing 3, an opening 3*a* exposing most part of the image-recording unit 2 is provided. The opening 3*a* is covered with some material such as acryl or the like which shields propagation of ultraviolet rays, although the some material is not shown in the figure. In the rear of the housing 3, a slit-shaped supply opening (not shown) for conveying the recording medium into the housing 3 is provided.

In the image-recording unit 2, a flat plate-shaped platen 4 extending in the right-and-left direction with predetermined width is placed. The platen 4 supports a non-recording surface (opposite to a recording surface) of the recording medium in flat ways. On top of the platen 4, a plurality of suction openings 4*a*, 4*a* . . . are arranged, and below the platen 4, a suction chamber (not shown) having a fan is placed. Each suction opening 4*a* is connected to the suction chamber. When the fan of the suction chamber has been driven, the non-recording surface of the recording medium is sucked by each suction opening 4*a*. Accordingly the upper surface of the platen 4 and the non-recording surface of the recording medium can be stuck together.

As shown in FIG. 1B, a publicly known rubber heater 4*b* for heating the platen 4 at a predetermined temperature is placed in the lower portion of the platen 4. Instead of the platen heater 4*b*, a halogen lamp 4*c* may be placed under or in the bottom of the platen 4 so that the radiant heat of the halogen lamp 4*c* heats the platen 4.

In FIG. 1A, although the recording medium on which the image should be recorded is not shown, the recording medium is fed from the supply opening provided in the rear of the housing 3. In the state that the non-recording surface is sucked and held by the platen 4, the recording medium passes through the housing 3 from the back to the front thereof by a conveyance mechanism (for example, driving roller, not shown) provided in the housing 3. Further, the recording medium is conveyed out of the housing 3. In other words, the recording medium is conveyed along a conveyance direction A so as to pass through (the image-recording unit 2) inside of the housing 3 by the conveyance mechanism.

Above the platen 4, an elongated guide member 5 extending in the right-and-left direction is provided in the housing 3. On the guide member 5, a carriage 6 is supported. The carriage 6 is movable along a scan direction B extending in the right-and-left direction in the state that the carriage 6 is guided and supported by the guide member 5.

In the carriage 6, four recording heads 7 to 10 for jetting ink of each process color of yellow (Y), magenta (M), cyan (C) and black (K) are mounted in line. In the bottom of each recording head 7 to 10, a plurality of nozzles (not shown) for jetting the ink of Y, C, M and K as minute liquid drops are arrayed respectively. Inside of each recording head 7 to 10, temperature sensors 7*a* to 10*a* (refer to FIG. 2A) as first temperature sensors for detecting the temperature of the ink are placed. Also, heaters 7*b* to 10*b* (refer to FIG. 2A) for heating the ink by generating heat are placed. Additionally, between the recording head 8 for jetting the ink of M and the recording head 9 for jetting the ink of C, a temperature sensor 13 as a second temperature sensor is placed. The temperature sensor 13 is placed at approximately the same height of the nozzles placed on each recording head 7 to 10, and capable of detecting the temperature in the neighborhood of the nozzles.

Further, in the carriage 6, on both right-and-left sides of the recording heads 7 to 10, ultraviolet rays sources 11 and 12 for irradiating the ultraviolet rays downward by being turned on are placed respectively. Concretely, as the ultraviolet rays sources 11 and 12, a low pressure mercury lamp, an ultraviolet rays laser beam, a xenon flash lamp, an insect-attracting light, a black light, a germicidal light, a cold cathode tube, a LED high pressure mercury lamp, a metal halide lamp, an electrodeless ultraviolet rays ramp or the like are applied, but other light sources may be applied.

To the left of platen 4 in FIG. 1A, four main tanks 21 to 24 for pooling the ink of each process color of Y, M, C and K are placed. Between the main tanks 21 to 24 and the above-mentioned recording heads 7 to 10, flexible tubes (not shown) are connected respectively at each color of the ink. The ink pooled in each main tank 21 to 24 is supplied to the recording heads 7 to 10 through the flexible tube.

In the inkjet printer 1 comprising the above-mentioned structure, the lower portion of the image-recording unit 2 is supported by two inverse T-shaped legs 40 and 40. Between each of the legs 40 and 40, two stiffeners 41 and 41 for tightly supporting the empty-weight of various members placed in the image-recording unit 2 or the like are spanned. Beneath each leg 40, two casters 42 and 42 are placed respectively. By such a structure, the inkjet printer 1 including the image-recording unit 2 is movable in the back-and-forth or right-and-left direction.

Figures 2A, 2B, 2C:
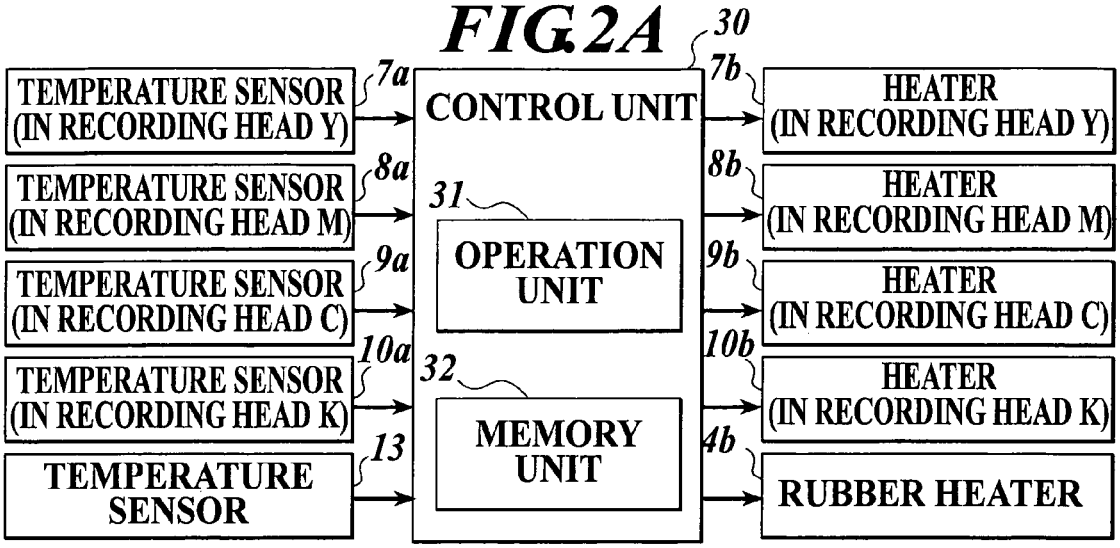
FIG. 2A is a block diagram showing a control structure of the inkjet printer in the first embodiment.
FIG. 2B and FIG. 2C are views showing a data table stored in the memory unit of the control unit in the first embodiment.

Next, with reference to FIG. 2A, FIG. 2B and FIG. 2C, a control structure of the inkjet printer 1 will be explained. FIG. 2A is a block diagram showing the control structure of the inkjet printer 1. FIG. 2B and FIG. 2C are drawings showing each data table stored in the memory unit 32 of the control unit 30.

As shown in FIG. 2A, to the control unit 30 for controlling the operation of each unit of the inkjet printer 1, the rubber heater 4*b*, the temperature sensors 7*a* to 10*a* and the heaters 7*b* to 10*b* placed in the recording heads 7 to 10, and the temperature sensor 13 mounted in the carriage 6, are connected. Additionally, in the control unit 30, an operation unit 31 for outputting a control signal to each unit by operating various data according to a control program, and a memory unit 32 for storing the control program and various data, are placed respectively.

In the first embodiment, the operation unit 31 of the control unit 30 controls the rubber heater 4*b* so that the rubber heater 4*b* generates heat at the predetermined temperature (for example, 50[° C.]) based on the result detected by the temperature sensor 13. Further, in the first embodiment, the ink in the recording heads 7 to 10 can be heated and controlled at the predetermined temperature (the set value [° C.]) by the above-mentioned control unit 30. The above-mentioned set value is stored in the memory unit 32 of the control unit 30. Further, in the memory unit 32, each data table shown in FIG. 2B and FIG. 2C is stored.

The first data table shown in FIG. 2B shows a first correction value [° C.] corresponding to first factors of resolution [dpi (dot per inch)], movement speed of the carriage 6 [m/s], the number of times of the movement of the carriage 6 (the movement of the carriage 6 along the forth or back direction is counted as a single movement), recording area [pixel elements (number)], and recording medium width [mm].

Meanwhile, the second data table shown in FIG. 2C shows a second correction value [° C.] corresponding to second factors of the first correction value based on the data table of FIG. 2B and the detected temperature [° C.] in the neighborhood of the nozzles of each recoding head 7 to 10 (the temperature detected by the temperature sensor 13).

Incidentally, in the data table shown in FIG. 2B, only part of the first correction values are shown, based on each recording medium width under the condition as follows: the resolution is 720 [dpi]; the movement speed of the carriage 6 is 0.5 [m/s]; the number of times of movement of the carriage 6 is 20 [times]; and the recording area is 50000 to 100000 [pixel elements]. In the memory unit 32, of course, the first correction values, which are based on each value of the first factors of resolution, movement speed of the carriage 6, the number of times of movement of the carriage 6, recording area, and recording medium width other than those values shown in FIG. 2B, are stored. Additionally, in the same way, in the data table shown in FIG. 2C, only part of the second correction values, which are based on each detected temperature in the neighborhood of the nozzles of each recording head 7 to 10 under the condition of +2[° C.] as the first correction value, are shown. In the memory unit 32, of course, the second correction values, which are based on each value of the second factors of the first correction value and the detected temperature in the neighborhood of the nozzles of each recording head 7 to 10 other than those values shown in FIG. 2C, are stored.

Next, the "ink" used in the first embodiment will be explained.

The ink used in the first embodiment is photocurable ink having property capable of being cured with irradiation of ultraviolet rays as light. The ink includes, as major component, at least a polymerizable compound (including publicly known polymerizable compound), photoinitiator and color material. Further, the ink has viscosity of 10 to 500 mPas at 30° C.

The above-mentioned photocurable ink is roughly classified into, as polymerizable compounds, the radical polymerization system ink including radical polymerizable compounds and cationic polymerization system ink including cationic polymerizable compounds. Both the types of the ink are respectively applicable as the ink used in the first embodiment. Further, hybrid type ink compounded of radical polymerization system ink and cationic polymerization system ink may be also applied as the ink used in the first embodiment. In the first embodiment, among the photocurable ink, the cationic polymerization system ink is used.

Incidentally, the cationic polymerization system ink used in the first embodiment is, concretely, mixture including at least, cationic polymerization compound such as oxetan compound, epoxy compound, vinyl ether compound or the like, photo-cationic initiator, and color material. Of course, the ink has property capable of being cured with irradiation of ultraviolet rays.

Next, the recording medium used in the first embodiment will be explained.

As the recording medium used in the first embodiment, various types of paper applied to general inkjet printers such as plain paper, regenerated paper., glossy paper or the like, various types of textile, various types of nonwoven fabric, and recording media made of resin, metal, glass or the like, are applicable. As the shape of the recording medium, roll shape, cut-sheet shape, plate shape or the like are applicable.

Especially, as the recording medium used in the first embodiment, a transparent or an opaque non-absorption nature resin film used for so-called flexible packaging are applicable. As the concrete resin type of resin film, polyethylene terephthalate, polyester, polyolefin, polyamide, polyesteramide, polyether, polyimide, polyamideimide, polystyrene, polycarbonate, poly-p-phenylenesulfide, polyetherester, polyvinylchloride, poly(meta)acrylate, polyethylene, polypropylene, nylon or the like are applicable. Further, copolymer of these resins, mixture of these resins, crosslinking of these resins or the like are also applicable. It is preferred that among all, as the type of resin film, any of polyethylene terephthalate, polystyrene, polypropylene or nylon, which are elongated, are selected in terms of transparency, dimensional stability, stiffness, environmental burden, cost or the like of the resin film. In addition, it is preferable to use the resin film having thickness of 2 to 100 μm (preferably, 6 to 50 μm). In addition, on the surface of the supports for the resin film, surface treatments such as a corona discharge treatment, a pre-treatment or the like may be carried out.

Further, as the recoding medium used in the first embodiment, a publicly known opaque recording medium such as various types of paper coated its surface with resin, a film comprising pigments, a formed film or the like are also applicable.

Next, image-recording operation of the inkjet printer 1 will be explained.

When the image-recording operation of the inkjet printer 1 has started, in the image-recording-unit 2, the conveyance structure placed in the housing 3 is activated. And then, the recording medium is conveyed to the supply opening of the housing 3. While the recording medium is stuck fast to the upper surface of the platen 4 in the state that the non-recording surface is sucked and supported by the platen 4, the recording medium passes from back to front in the housing 3, and is conveyed along the conveyance direction A. In this condition, the carriage 6 is activated and moves back-and-forth just over the recording medium along the scan direction B. Then, the recording heads 7 to 10 move along the back or the forth passage of the carriage 6 while they follow the back-and-forth movement of the carriage 6. During that movement, the recording heads 7 to 10 jet the ink of each color of Y, M, C and K respectively toward the recording surface of the recording medium as minute liquid drops.

Here, in the inkjet printer 1 of the first embodiment, as the feature thereof, the control unit 30 corrects the set value stored in the memory unit 32 based on the first and second correction values derived from each data table of FIGS. 2B and 2C. Then, the ink in the recording heads 7 to 10 is jetted from each nozzle at the temperature extremely close to the set value.

Concretely, at first, at the stage before the image-recording operation to the recording medium is started, image information is input to the control unit 30. Then the operation unit 31 of the control unit 30 determines a plurality of values of the first factors (the resolution, movement speed of the carriage 6, the number of times of movement of the carriage 6, recording area and recording medium width) defined based on the image information, from the input image information. Here, for example, the case of the condition of following will be explained as an example: the set value stored in the memory unit 32 of the control unit 30 is "30 [° C.]", and as for the value of each first factor defined based on the image information, the resolution is 720 [dpi]; the movement speed of the carriage 6 is 0.5 [m/s]; the number of times of movement of the carriage 6 is 20; the recording area is 50000 to 100000 [pixel elements]; and the recording medium width is 300 [mm].

In this case, the operation unit 31 of the control unit 30 determines the value of each first factor defined based on the image information, as mentioned above. Moreover, the operation unit 31 specifies the first correction value corresponding to the determined values of first factors, from the data table of FIG. 2B stored in the memory unit 32. In other words, hereat, the operation unit 31 specifies the value of "+2 [° C.]" as the first correction value (refer to FIG. 2B).

Then, the operation unit 31 carries out the processing for adding the specified first correction value ("+2 [° C.]") to the set value ("30 [° C.]"). Further, the operation unit 31 outputs the control signal for making the heaters 7*b* to 10*b* generate heat at the temperature of the addition processed value, based on the result detected by each temperature sensor 7*a* to 10*a*. Accordingly, each heater 7*b* to 10*b* generates heat to keep its temperature at "32 (=30+2) [° C.]". And then, the ink in each recording head 7 to 10 is heated and controlled at "32 [° C.]".

In this condition, during the movement of the carriage 6, the recording heads 7 to 10 jet the ink of each color of Y, M, C and K heated and controlled at "32 [° C.]" as minute liquid drops respectively, from each nozzle toward the recording surface of the recording medium.

After the predetermined time has gone by, the temperature sensor 13 mounted in the carriage 6 detects the temperature during the movement of the carriage 6. Then, the operation unit 31 of the control unit 30 specifies the second correction value corresponding to the values of the second factors of the temperature detected by the temperature sensor 13 and the first correction value specified first, from the data table of FIG. 2C stored in the memory unit 32. For example, the case of "27 [° C.]" as the temperature detected by the temperature sensor 13 will be explained as an example. The operation unit 31 specifies the second correction value corresponding to the first correction value specified first ("+2 [° C.]" (refer above)) and the temperature detected by the temperature sensor 13 ("27 [° C.]"), from the data table of FIG. 2C. In other words, hereat, the operation unit 31 specifies the value of "+3 [° C.]" as the second correction value (refer to FIG. 2C).

And then, the operation unit 31 carries out the processing for adding, instead of the first correction value specified first ("+2 [° C.]"), the second correction value ("+3 [° C.]") specified later to the set value ("30 [° C.]"). Further, the operation unit 31 outputs the control signal for making the heaters 7*b* to 10*b* generate heat at the temperature of the addition processed value, based on the result detected by each temperature sensor 7*a* to 10*a*. Accordingly, each heater 7*b* to 10*b* generates heat by raising its temperature to keep its temperature at "33 (=30+3) [° C.]". And then, the ink in each recording head 7 to 10 is heated and controlled at "33 [° C.]".

And next, during the movement of the carriage 6, the recording heads 7 to 10 jet the ink of each color of Y, M, C and K heated and controlled at "33 [° C.]" as minute liquid drops respectively, from each nozzle toward the recording surface of the recording medium.

Incidentally, in the first embodiment, the above-mentioned correction processing for the set value based on the second correction value is carried out every elapse of the predetermined time during the back-and-forth movement of the carriage 6. In addition, according to the temperature detected by the temperature sensor 13, the second correction value is rewritten and updated as needed.

Further, in the inkjet printer 1 of the first embodiment, the ultraviolet rays sources 11 and 12 also follow the back-and-forth movement of the carriage 6 as the above-mentioned recording heads 7 to 10 do. Then, one or the other of the two ultraviolet rays sources 11 and 12 lights during the movement of the carriage 6 along the back or the forth passage. For details, during the movement of the carriage 6 in the direction from left to right in FIG. 1A, the ultraviolet rays source 11 lights, and during the movement of the carriage 6 in the direction from right to left in FIG. 1A, the ultraviolet rays source 12 lights. In other words, the ultraviolet rays source 11 (or 12) in rear of the recording heads 7 to 10 in the direction of the movement of the carriage 6 lights. And accordingly, the ink jetted from each recording head 7 to 10 is cured with irradiation of the ultraviolet rays soon after the ink has been landed on the recording medium. Then the ink is fixed on the recording surface of the recording medium.

From then on, the inkjet printer 1 repeats each of above-mentioned operation. Then the intended image consisting of a plurality of dots of each process color of Y, M, C and K is recorded sequentially on the recording surface of the recording medium.

In the above-mentioned inkjet printer 1, during the image-recording operation, air flow occurs in the neighborhood of the nozzles of each recording head 7 to 10 because of the movement of the carriage 6, the suction from each suction opening 4*a* on the platen 4 or the like. Then, the temperature in the neighborhood of the nozzles of each recording head 7 to 10 becomes lower than that of outside air. However, the first correction value is specified from the image information before the image-recording operation. And then, the set value is corrected beforehand based on the specified first correction value. Therefore, the ink controlled its temperature in the condition close to the set value can be jetted from the nozzles of each recording head 7 to 10. Accordingly, the ink of the optimal viscosity for the image-recording can be jetted from the nozzles of each recording head 7 to 10. Consequently, the quality of the image can be improved.

Further, in the inkjet printer 1, the temperature of each recording head 7 to 10 is detected by the temperature sensor 13 every elapse of the predetermined time during the image-recording operation. In addition, the set value is corrected as needed based on the second correction value. Therefore, during the image-recording operation, the ink controlled its temperature in the condition extremely close to the set value can be always jetted from the nozzles of each recording head 7 to 10. Further, the ink of the optimal viscosity for the image-recording is certainly jetted from the nozzles of each recording head 7 to 10.

Second Embodiment

Next, the second embodiment will be explained. The inkjet printer 1 in the second embodiment has approximately same structure as that of the inkjet printer 1 explained in the first embodiment. Therefore in the second embodiment, as for the elements of the structure of the inkjet printer 1 explained in the first embodiment, the explanation of them (including the ink and recording medium) will be omitted by putting the same reference characters as ones described above. And then, structure and operation differing from that of the first embodiment will be explained mainly.

Figure 3:
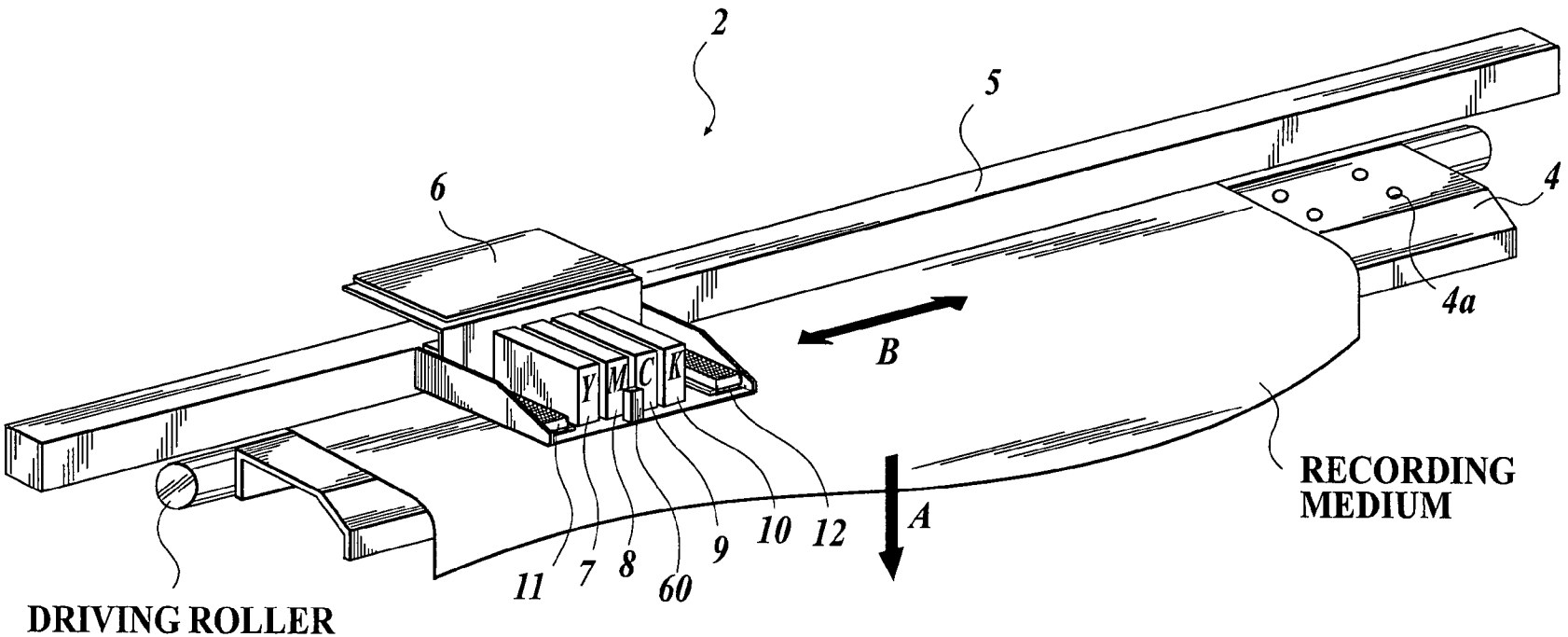
FIG. 3 is a perspective view showing part of structure of the inkjet printer in the second embodiment.

As shown in FIG. 3, in the carriage 6, instead of the temperature sensor 13 shown in FIG. 1A and FIG. 2A, a temperature sensor 60 for detecting the temperature of the recording medium is placed. The temperature sensor 60 as the third temperature sensor is a publicly known noncontact type reflecting temperature sensor comprising a light emitter for emitting infrared rays and a photo detector for receiving infrared rays. The temperature sensor 60 moves just over the recording medium while it follows the back-and-forth movement of the carriage 6. In addition, during the movement, the temperature sensor 60 detects the temperature of the recording medium.

Figures 4A, 4B:
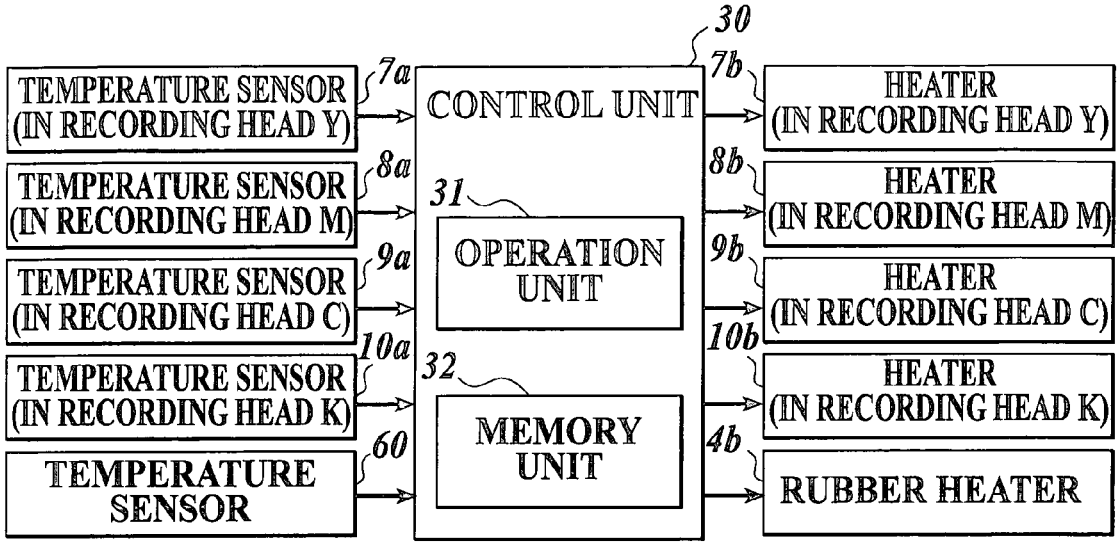
FIG. 4A is a block diagram showing a control structure of inkjet printer in the second embodiment.
FIG. 4B is a drawing showing a data table stored in the memory unit of the control unit in the second embodiment.

As shown in FIG. 4A, the temperature sensor 60 is connected to the control unit 30. In the memory unit 32 of the control unit 30, instead of the data table shown in FIG. 2C, the data table shown in FIG. 4B is stored.

In the third data table shown in FIG. 4B, the third correction value [° C.] corresponding to the third factors of the first correction value based on the data table in FIG. 2B and the detected temperature of the recording medium (temperature detected by the temperature sensor 60) [° C.] is stored.

Incidentally, in the data table shown in FIG. 4B, only part of the third correction values, which are based on the detected temperature of the recording medium under the condition of +2 [° C.] as the first correction value, are shown. In the memory unit 32, of course, the third correction values, which are based on each value of the third factors of the first correction value and the detected temperature of the recording medium other than those values shown in FIG. 4B, are stored.

Next, the action during the image-recording operation of the inkjet printer 1 will be explained.

In the case that the set value stored in the memory unit 32 of the control unit 30 is "30 [° C.]" and the operation unit 31 of the control unit 30 specifies the value of "+2 [° C.]" as the first correction value, during the image-recording operation of the inkjet printer 1, the temperature sensor 60 mounted in the carriage 6 detects the temperature of the recording medium. Then, the operation unit 31 of the control unit 30 specifies the third correction value corresponding to the values of the third factors of the temperature detected by the temperature sensor 60 and the first correction value specified first, from the data table of FIG. 4B stored in the memory unit 32. For example, the case of "50 [° C.]" as the temperature detected by the temperature sensor 60 will be explained as an example. The operation unit 31 specifies the third correction value corresponding to the first correction value specified first ("+2 [° C.]" (refer to the first embodiment)) and the temperature detected by the temperature sensor 60 ("50 [° C.]"), from the data table of FIG. 4B. In other words, hereat, the operation unit 31 specifies the value of "+2 [° C.]" as the third correction value (refer to FIG. 4B).

Then, the operation unit 31 carries out the processing for adding, instead of the first correction value specified first, the third correction value ("+2 [° C.]") specified later to the set value ("30 [° C.]"). Further, the operation unit 31 outputs the control signal for making the heaters 7*b* to 10*b* generate heat at the temperature of the addition processed value, based on the result detected by each temperature sensor 7*a* to 10*a*. And accordingly, each heater 7*b* to 10*b* generates heat for keeping its temperature at "32 (=30+2) [° C.]". And then, the ink in each recording head 7 to 10 is heated and controlled at "32 [° C.]".

In this condition, during the movement of the carriage 6, the recording heads 7 to 10 jet the ink of each color of Y, M, C and K heated and controlled at "32 [° C.]" as minute liquid drops respectively, from each nozzle toward the recording surface of the recording medium.

Incidentally, in the second embodiment, the above-mentioned correction processing for the set value based on the third correction value is carried out every elapse of the predetermined time during the back-and-forth movement of the carriage 6. In addition, according to the temperature detected by the temperature sensor 60, the third correction value is rewritten and updated as needed.

In the above-mentioned inkjet printer 1, the temperature of the recording medium is detected by the temperature sensor 60 every elapse of the predetermined time during the image-recording operation. In addition, the set value is corrected as needed based on the third correction value. Therefore, during the image-recording operation, the ink corresponding to the temperature of the recording medium can be jetted from each nozzle of each recording head 7 to 10. Consequently, the quality of the image recorded on the recording medium can be improved.

Third Embodiment

Next, the third embodiment will be explained.

The inkjet printer 1 used in the third embodiment has approximately same structure as that of the inkjet printer 1 explained in the first embodiment. Therefore in the third embodiment, as for the elements of the structure of the inkjet printer 1 explained in the first embodiment, the explanation of them (including the ink and recording medium) will be omitted by putting the same reference characters as ones described above. Then, structure and operation differing from that of the first embodiment will be explained mainly.

Figure 5:
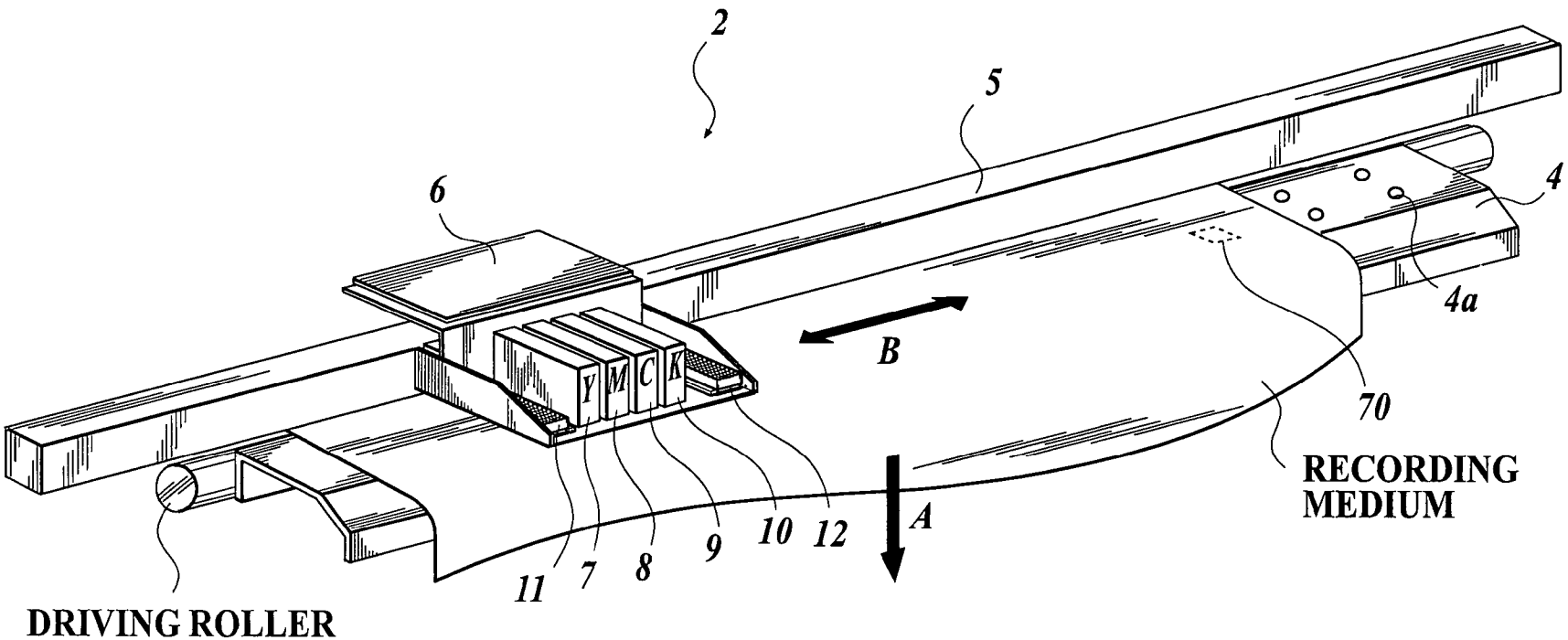
FIG. 5 is a perspective view showing part of structure of the inkjet printer in the third embodiment.
Figures 6A, 6B:
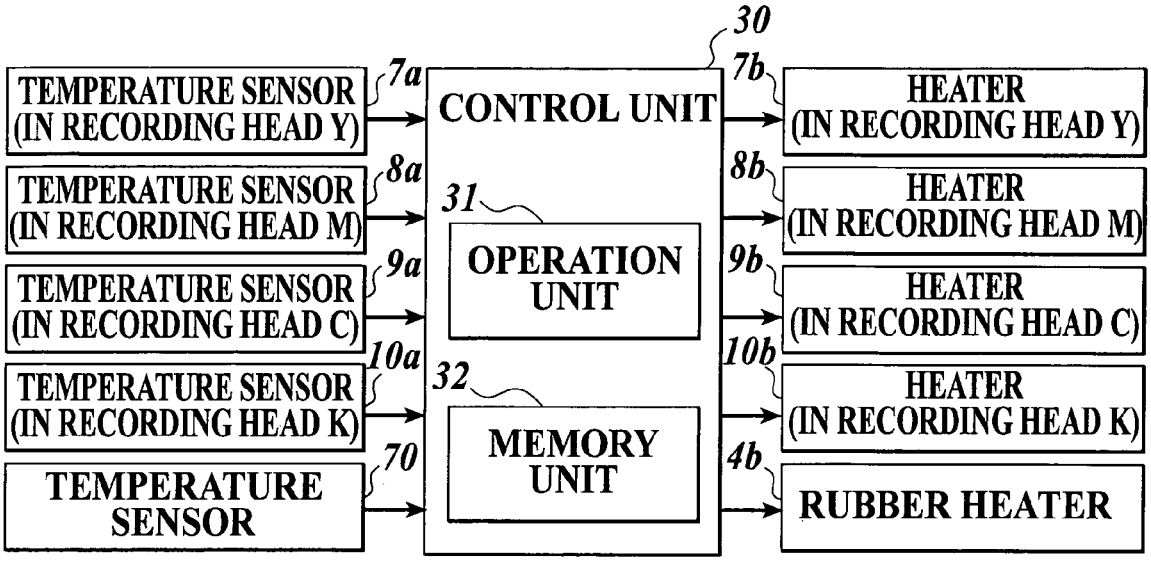
FIG. 6A is a block diagram showing a control structure of the inkjet printer in the third embodiment.
FIG. 6B is a drawing showing a data table stored in the memory unit of the control unit in the third embodiment.

As shown in FIG. 5, in the platen 4, instead of the temperature sensor 13 shown in FIG. 1A and FIG. 2A, a temperature sensor 70 for detecting the temperature of the surface of the platen 4 is placed. The temperature sensor 70 as the fourth temperature sensor is a publicly known contact type reflecting temperature sensor. The temperature sensor 70 detects the temperature of the surface of the platen 4 for detecting the temperature of the recording medium touching the surface of the platen 4, As shown in FIG. 6A, the temperature sensor 70 is connected to the control unit 30. In the memory unit 32 of the control unit 30, instead of the data table shown in FIG. 2C, the data table shown in FIG. 6B is stored.

In the fourth data table shown in FIG. 6B, the fourth correction value [° C.] corresponding to the fourth factors of the first correction value based on the data table in FIG. 2B and the detected temperature of the surface of the platen 4 (temperature detected by the temperature sensor 70) [° C.] is stored.

Incidentally, in the data table shown in FIG. 6B, only part of the fourth correction values, which are based on the detected temperature of the surface of the platen 4 under the condition of +2 [° C.] as the first correction value, are shown. In the memory unit 32, of course, the fourth correction values, which are based on each value of the fourth factors of the first correction values and the detected temperature of the platen 4 other than those values shown in FIG. 6B, are stored.

Next, the action during the image-recording operation of the inkjet printer 1 will be explained.

In the case that the set value stored in the memory unit 32 of the control unit 30 is "30 [° C.]" and the operation unit 31*d* of the control unit 30 specifies the value of "+2 [° C.]" as the first correction value, during the image-recording operation of the inkjet printer 1, the temperature sensor 70 placed in the platen 4 detects the temperature of the surface of the platen 4. Then, the operation unit 31 of the control unit 30 specifies the fourth correction value corresponding to the values of the fourth factors of the temperature detected by the temperature sensor 70 and the first correction value specified first, from the data table of FIG. 6B stored in the memory unit 32. For example, the case of "50 [° C.]" as the temperature detected by the temperature sensor 70 will be explained as an example. The operation unit 31 specifies the fourth correction value corresponding to the first correction value specified first ("+2 [° C.]" (refer to the first embodiment)) and the temperature detected by the temperature sensor 70 ("50 [° C.]"), from the data table of FIG. 6B. In other words, hereat, the operation unit 31 specifies the value of "+2 [° C.]" as the fourth correction value (refer to FIG. 6B).

Then, the operation unit 31 carries out the processing for adding, instead of the first correction value ("+2 [° C.]") specified first, the fourth correction value ("+2 [° C.]") specified later to the set value ("30 [° C.]"). Further, the operation unit 31 outputs the control signal for making the heaters 7*b* to 10*b* generate heat at the temperature of the addition processed value, based on the result detected by each temperature sensor 7*a* to 10*a*. Accordingly, each heater 7*b* to 10*b* generates heat to keep its temperature at "32 (=30+2) [° C.]". And then, the ink in each recording head 7 to 10 is heated and controlled at "32 [° C.]".

In this condition, the recording heads 7 to 10 jet the ink of each color of Y, M, C and K heated and controlled at "32 [° C.]" as minute liquid drops respectively, from each nozzle toward the recording surface of the recording medium during the movement of the carriage 6.

Incidentally, in the third embodiment, the above-mentioned correction processing for the set value based on the fourth correction value is carried out every elapse of the predetermined time during the image-recording operation. In addition, the fourth correction value is rewritten and updated as needed according to the temperature detected by the temperature sensor 70.

In the above-mentioned inkjet printer 1, the temperature of the surface of the platen 4 is detected by the temperature sensor 70 every elapse of the predetermined time during the image-recording operation. In addition, the set value is corrected as needed based on the fourth correction value. Therefore, the ink corresponding to the temperature of the surface of the platen 4 (in other words, the temperature of the recording medium, which is conducted by the heat of the platen 4) can be jetted from the nozzles of each recording head 7 to 10 during the image-recording operation. Consequently, the quality of the image recorded on the recording medium can be improved.

Incidentally, the present invention is not limited to the above-mentioned first to third embodiment and may be modified or changed design diversely without departing from the essence thereof.

For example, in the above-mentioned first to third embodiment, the correction processing for the set value based on the first correction value is carried out at the early stage of the image-recording, after that, the correction processing for the set value based on the second, third and fourth correction values are carried out respectively every elapse of the predetermined time as needed. However, it may be permitted that only the correction processing for the set value based on the first correction value is carried out without the correction processing for the set value based on the second, third and fourth correction values being carried out, and after that, the image-recording operation is continued according to the correction processing for the set value based on the first correction value. In this case, since each of the data tables of FIG. 2C, FIG. 4B and FIG. 6B are not needed, the control structure can be simplified. Further, since there is no need for mounting the temperature sensors 13 and 60 in the carriage 6 and placing the temperature sensor 70 in the platen 4, the cost of the temperature sensors 13, 60 and 70 can be reduced.

Figure 7:
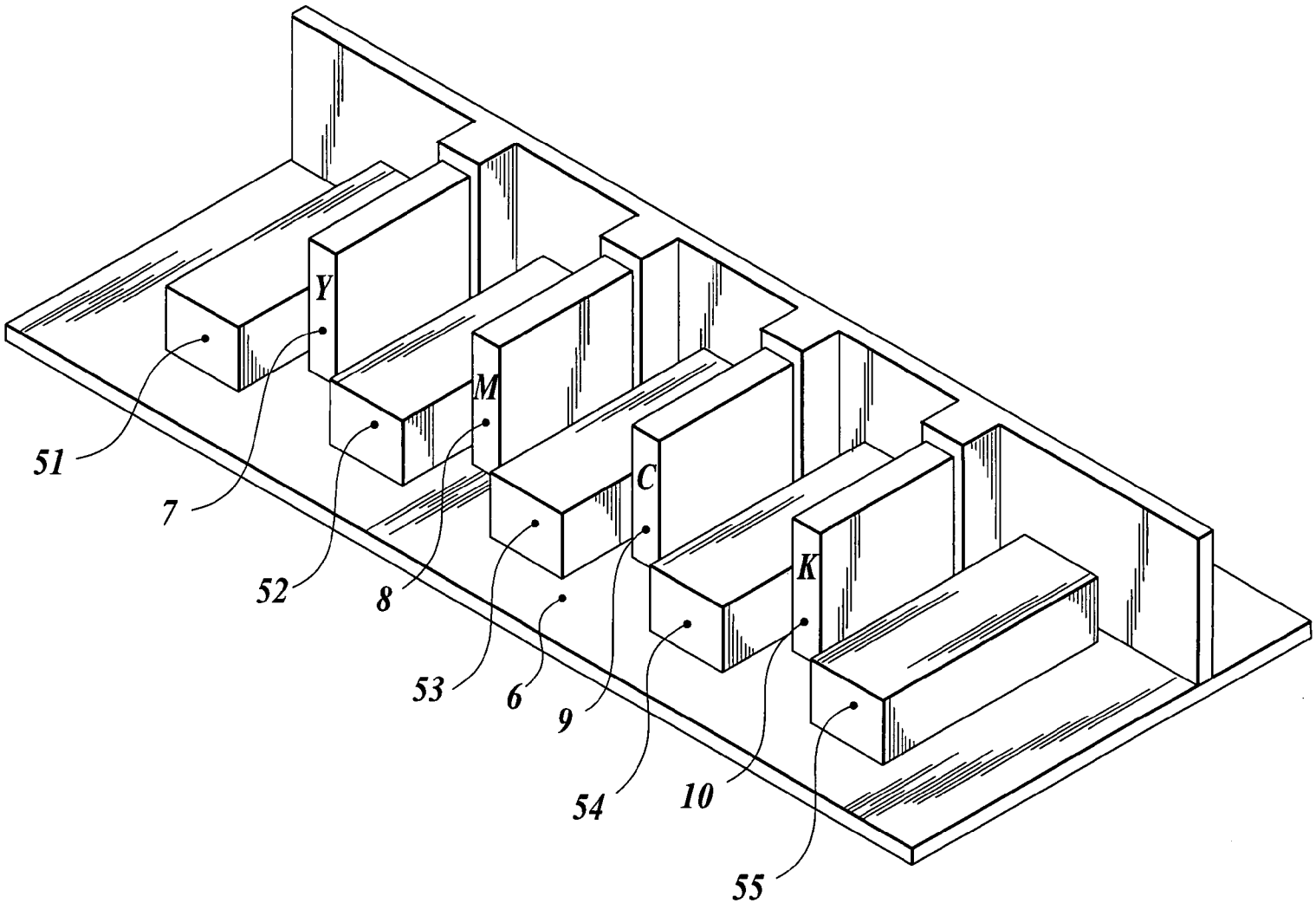
FIG. 7 is a perspective view showing a modified example of arrangement of ultraviolet rays sources shown in FIG. 1A, FIG. 3, and FIG. 5.

Further, in the above-mentioned first to third embodiment, as shown in FIG. 1A, FIG. 3 and FIG. 5, the ultraviolet rays sources 11 and 12 are placed only on both right and left sides of the carriage 6, however, as shown in FIG. 7, the ultraviolet rays sources 51 to 55 may be placed on both right and left sides of each recording head 7 to 10 respectively.

Incidentally, the ink used in the above-mentioned first to third embodiment (including the radical polymerization system ink, cationic polymerization system ink and hybrid type ink) is curable with irradiation of the ultraviolet rays as mentioned above. However, not always limited to them, the ink may be curable with the light other than the ultraviolet rays. The "light" mentioned here is the light in a broad sense, including such as ultraviolet rays, electromagnetic waves, electron rays, X-rays, visible rays, infrared rays or the like. In other words, for the ink used in the above-mentioned first to third embodiment, the polymerizable compound which is polymerized and cured with the light other than the ultraviolet rays, and photoinitiator which starts the polymerize reaction among the polymerizable compounds with light other than ultraviolet rays, may be applied. When the photocurable ink cured with the light other than the ultraviolet rays is used as the ink used in the above-mentioned first to third embodiment, a light source for irradiating those light needs to be applied, instead of the ultraviolet rays sources 11 and 12 shown in FIG. 1A, FIG. 3 and FIG. 5 and the ultraviolet rays sources 51 to 55 shown in FIG. 7.

The entire disclosure of Japanese Patent Application No. Tokugan 2003-018604 filed on Jan. 28, 2003 including specification, claims, drawings and summary are incorporated herein by reference in its entirety.

What is claimed is:

1. An inkjet printer comprising:

a recording head having a plurality of nozzles for jetting ink that is contained in the recording head;

a movable carriage for supporting the recording head, such that an image is recorded on a recording medium by jetting the ink from the nozzles of the recording head while the carriage is moved based on image information;

a first temperature sensor for detecting a temperature of the ink in the recording head;

a heater for heating the ink in the recording head by generating heat; and a control unit for controlling the heater based on a result detected by the first temperature sensor, wherein in the control unit, a set value for defining a heating temperature of the heater is stored, and first factors including a movement speed of the carriage and a number of times of movement of the carriage, which are determined based on the image information, and a first correction value corresponding to the first factors are stored as a first data table; and wherein the control unit determines the first factors including the movement speed of the carriage and the number of times of movement of the carriage from the image information, specifies the first correction value corresponding to the determined first factors from the first data table, corrects the set value based on the specified first correction value, and controls the heater in accordance with the corrected set value.

2. The inkjet printer of claim 1, further comprising:

a second temperature sensor for detecting a temperature in a neighborhood of the nozzles of the recording head, wherein in the control unit, second factors, including the first correction value and a result detected by the second temperature sensor, and a second correction value corresponding to the second factors are stored as a second data table; and wherein the control unit specifies the second correction value corresponding to the first correction value specified from the first data table and the result detected by the second temperature sensor from the second data table, corrects the set value based on the specified second correction value, and controls the heater in accordance with the corrected set value.

3. The inkjet printer of claim 1, further comprising:

a third temperature sensor for detecting a temperature of the recording medium, wherein in the control unit, third factors, including the first correction value and a result detected by the third temperature sensor, and a third correction value corresponding to the third factors are stored as a third data table; and wherein the control unit specifies the third correction value corresponding to the first correction value specified from the first data table and the result detected by the third temperature sensor from the third data table, corrects the set value based on the specified third correction value, and controls the heater for generating heat in accordance with the corrected set value.

4. The inkjet printer of claim 1, further comprising:

a platen for supporting the recording medium; and a fourth temperature sensor for detecting a temperature of the platen, wherein in the control unit, fourth factors, including the first correction value and a result detected by the fourth temperature sensor, and a fourth correction value corresponding to the fourth factors are stored as a fourth data table; and wherein the control unit specifies the fourth correction value corresponding to the first correction value specified from the first data table and the result detected by the fourth temperature sensor from the fourth data table, corrects the set value based on the specified fourth correction value and controls the heater for generating heat in accordance with the corrected set value.

* * * * *